US006666332B1

(12) United States Patent
DeWolf et al.

(10) Patent No.: US 6,666,332 B1
(45) Date of Patent: Dec. 23, 2003

(54) VARIABLE DISPLAY POSITION EXPANDED PRINTING SURFACE PACKAGE

(75) Inventors: Chris DeWolf, Cedar Rapids, IA (US); Lorin Reicks, Cedar Rapids, IA (US); Nancy McKinley, Cedar Rapids, IA (US); Steve Bosking, Cedar Rapids, IA (US)

(73) Assignee: Lil'Drug Store Products, Inc., Cedar Rapids, IA (US)

( * ) Notice: Subject to any disclaimer, the term of this patent is extended or adjusted under 35 U.S.C. 154(b) by 64 days.

(21) Appl. No.: 10/044,328

(22) Filed: Jan. 11, 2002

(51) Int. Cl.[7] ..... B65D 85/00

(52) U.S. Cl. ..... 206/459.5; 206/45.28; 206/806

(58) Field of Search ..... 206/806, 459.5, 206/756, 767, 45.28, 45.29, 736, 768

(56) References Cited

U.S. PATENT DOCUMENTS 877,347 A * 1/1908 Lazar ..... 221/63
3,667,667 A * 6/1972 Frankenberg ..... 229/123.2
3,814,303 A * 6/1974 Smith ..... 229/117.18
4,872,555 A * 10/1989 Shadrach III et al. ... 206/459.5
5,074,462 A * 12/1991 Countee, Jr. ..... 229/155
5,117,973 A * 6/1992 Lo Duca ..... 206/45.29
5,232,087 A * 8/1993 Schluger ..... 206/232
5,293,994 A * 3/1994 Antik ..... 206/387.1
5,497,876 A * 3/1996 Fleming ..... 206/232
5,779,048 A * 7/1998 Dunn ..... 206/449
5,971,261 A * 10/1999 Grunfeld et al. ..... 229/102
6,053,325 A * 4/2000 Yonker et al. ..... 206/736
6,209,292 B1 * 4/2001 Krahn ..... 53/458

* cited by examiner

*Primary Examiner*—Shian Luong
(74) *Attorney, Agent, or Firm*—James C. Nemmers

(57) ABSTRACT

A display package comprising a single sheet template adapted to receive printing on one side thereof is disclosed. The package comprises a container front panel, top panel, bottom panel, rear panel and two side panels, in combination with a display flap. Selected walls or "panels" may be extended to provide structures or reinforcement adapted to serve as load bearing hangers or other attachment means so that the product package may be displayed to consumers. Through the use of adhesives or other fastening means, the single piece construction may be made more rigid or durable at selected locations to promote resistance to disfiguration when manipulated by consumers at the point of display and prior to purchase, and to minimize undetected violation of product security. The package may be displayed in a variety of positions due to the use of printing in a variety of directions and selected placement of hangers.

11 Claims, 7 Drawing Sheets

FIG. 1
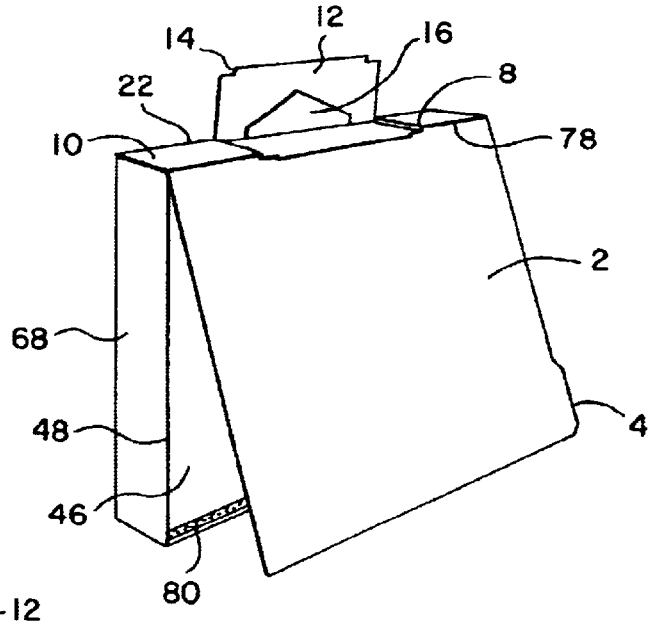
FIG. 2
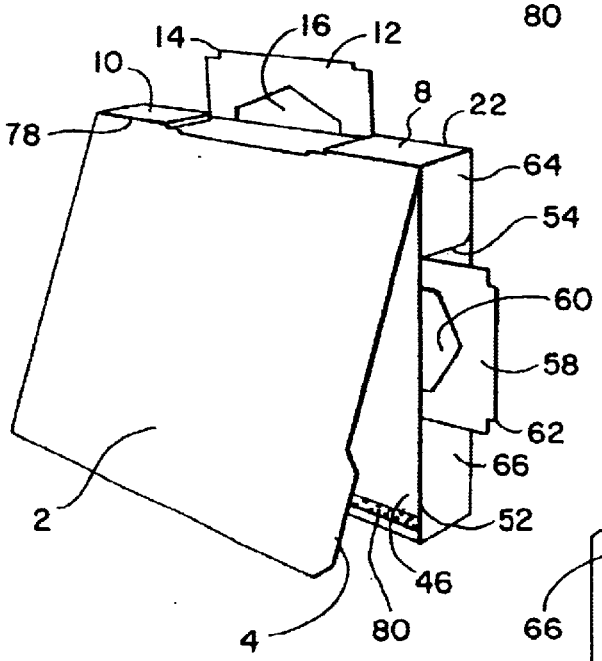
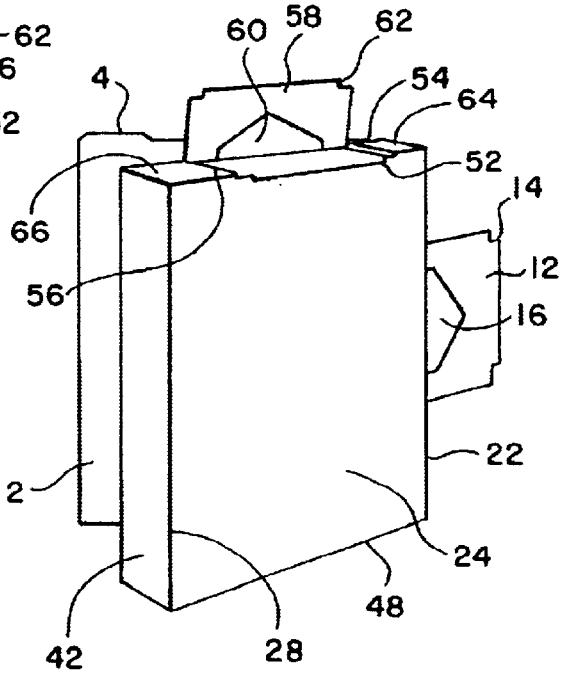
FIG. 3

VARIABLE DISPLAY POSITION EXPANDED PRINTING SURFACE PACKAGE

BACKGROUND OF INVENTION

This invention relates generally to a folding container and template therefore and specifically to a folding container for use with pharmaceutical or other consumer items wherein it is required or necessary to convey selected product information, directions, warnings, and other helpful or required data to consumers via the package exterior.

Various container configurations are disclosed in the prior art. Examples include U.S. Pat. No. 6,053,325 issued Apr. 25, 2000 to Yonker and Brunck. The container of the '325 patent comprises a foldable template formed of a single sheet of material including a series of score lines or fold lines that provide a hinged display panel in combination with a container. Additional prior art includes U.S. Pat. No. 6,608,115 issued May 30, 2000 to Boulton. The invention of Boulton comprises a container having a hinged flap attached thereto, which flap encloses a foldable, "accordion-style" printing surface that may be viewed when the flap is released from the container. In addition, numerous product package designs, exist wherein a housing flap or container wall is used to contain a slide-out informational sheet. Examples of issued patents related to product packaging having expanded or expandable writing surfaces thereon include: U.S. Pat. Nos. 6,053,325, 2,790,587, 6,068,115, 3,207,301, 3,076,541, 4,413,730, 4,472,895, 4,666,040, 3,347,358, 5,048,870, 4,889,238, 3,278,015, 5,806,670, 5,174,442, 4,711,348, 5,119,933, 5,575,384, 5,641,062, 5,497,876, 5,458,235, 5,096,058, 5,289,917, 5,775,494, and 4,010,299.

Important considerations in container design for containers having expanded writing or display surfaces thereon include convenient and inexpensive construction, minimum production of scrap or waste material during construction, ease of printing, durability, and, especially in combination with durability, package data presentation in a manner that allows consumers to view the data prior to purchase without destroying or otherwise disfiguring the product packaging. The prior art containers discussed herein have not adequately met these considerations.

Other considerations include package flexibility, labeling recognizability, and package durability sufficient to withstand automated package loading processes. Packaging flexibility is an important consideration, especially for small, retail item packaging. In convenience stores and other general merchandise retail outlets, it is common for the store owner or manager to periodically design and reconfigure product placement within the store. With limited shelf or display space, this periodic planning and reconfiguration can be critical to a store's success. However, a downside of rigid store space management is a difficulty related to the introduction of new products into a store's inventory between reconfiguration dates. To provide maximum opportunity for product suppliers to enter new stores where reconfiguration may be complete and little space remains for new product display, it is advantageous to provide products to retailers in a manner that will maximize flexibility in product presentation. Such flexibility allows retail managers to place new products in stores and at locations that might not otherwise be available to accommodate a less flexibly packaged product.

Labeling recognizability is critical both-for commercial success and for consumer safety. As FDA requirements for product labeling increase, the available space for product branding information necessarily decreases. Often, it is the trusted brand information rather than detailed ingredients listing that consumers use to ensure that they are receiving for example, their preferred or required choice among acetaminophen, aspirin, and ibuprofen when a pain-killer is needed. Therefore, there is not only a need to promote product awareness for the benefit of the product manufacturer or the retail manager, there is also a need to ensure consumer safety by ensuring that technical and verbose "official" labeling requirements do not interfere with branding information (which may actually provide more critical information in a form more likely to be used and relied-upon by consumers). The communication of branding information is particularly important for vending machine sales and other settings where consumers are likely to rely on branding information to determine product content.

On average, Applicant loads and distributes over 50 million non-prescription drug convenience packs every year. Such a volume of containers requires automation for efficient handling and loading. In the automated package loading process, package durability is an important consideration. When the various other product packaging demands are met, it is therefore necessary to ensure that the unsealed package remains durable enough to withstand the forces associated with moving through the machinery of an automated loading and sealing process. With such a high volume, even a low rate of scrap (waste created through package destruction during loading or package formation) can rise quickly to a figure of staggering economic impact.

The prior art has failed to adequately meet all of these various demands. It is therefore the object of the present invention to satisfy these various demands and thereby enhance consumer safety, retailer product placement flexibility, brand awareness and recognizability, package durability, and the minimization of waste in the production and loading processes.

SUMMARY OF INVENTION

The present invention comprises a container front panel, top panel, bottom panel, rear panel and two side panels, in combination with an auxiliary or display flap. The display flap includes a display flap interior panel and a display flap exterior panel. Selected walls or "panels" or portions thereof may be extended to provide structures or reinforcements adapted to serve as load bearing hangers or other attachment means so that the product package may be displayed to consumers. Through the use of mechanical or adhesive means (preferably a combination of binding and non-biding adhesives), a single piece construction may be made more rigid or durable at selected locations to promote resistance to disfiguration when manipulated by consumers at the point of display prior to purchase, and to require general disfigurement or destruction if the package is actually opened.

BRIEF DESCRIPTION OF DRAWINGS

FIG. 1 is a rear offset perspective view of an assembled container having a display flap.

FIG. 2 is a rear offset perspective view of an assembled container having a display flap.

FIG. 3 is a front offset perspective view of an assembled container having a display flap.

DETAILED DESCRIPTION

Herein the term "binding adhesive" is used to refer to an adhesive used to join container portions in a manner that generally does not allow reattachment after detachment. The term "non-binding adhesive" is used to refer to an adhesive used to join container portions in a manner that generally allows reattachment after detachment. The use of both types of adhesives is known in the art. In the context of the present invention, selected locations (such as locations used to seal the interior of the package) are joined with binding adhesive to create a package that cannot be opened without disfiguring or marring the package in a manner that would reveal tampering. Other locations, such as a display flap, are preferably restrained with nonbinding adhesive so that consumers may open the display flap and view product data on a reverse side of the display flap without damaging, the packaging. The preferred non-binding adhesive is a hot glue that is translucent when set and which meets the composition requirements under 21 CFR Section 175.105 for "Adhesives", which regulation is incorporated herein by reference in the form applicable as of the filing date of this application. Of course, depending on the intended use of the package, alternate non-binding adhesives or even mechanical means may be used. The preferred binding adhesive is a cold glue that is a high performance, water-based product that exhibits good machining characteristics. The preferred binding adhesive is made of synthetic resins, sets or drys clear, and is best stored at 40 degrees or higher.

In the market for non-prescription drugs in particular, there is a definite and clear need for packages that provide an abundance of panel space to convey product and branding information to consumers prior to purchase. Of course, with these very same products, it is important to consumers, retailers, and manufacturers that consumers be able to determine whether tampering has occurred and package contents have been accessed. Therefore, the use of binding and non-binding adhesives at selected locations allows these multiple purposes to be achieved.

Figure 4:
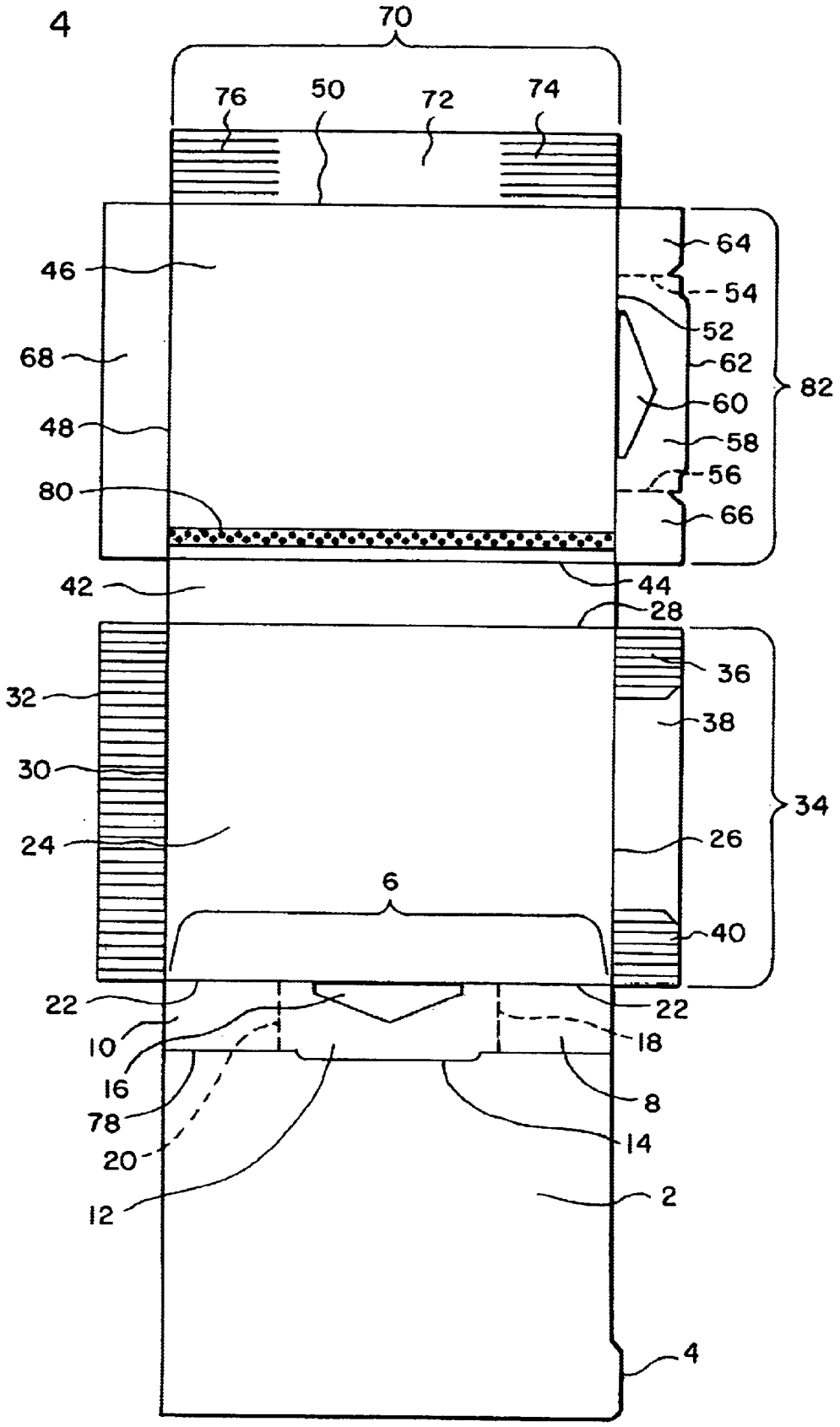
FIG. 4 is a plan view of a deconstructed container exterior face.
Figure 5:
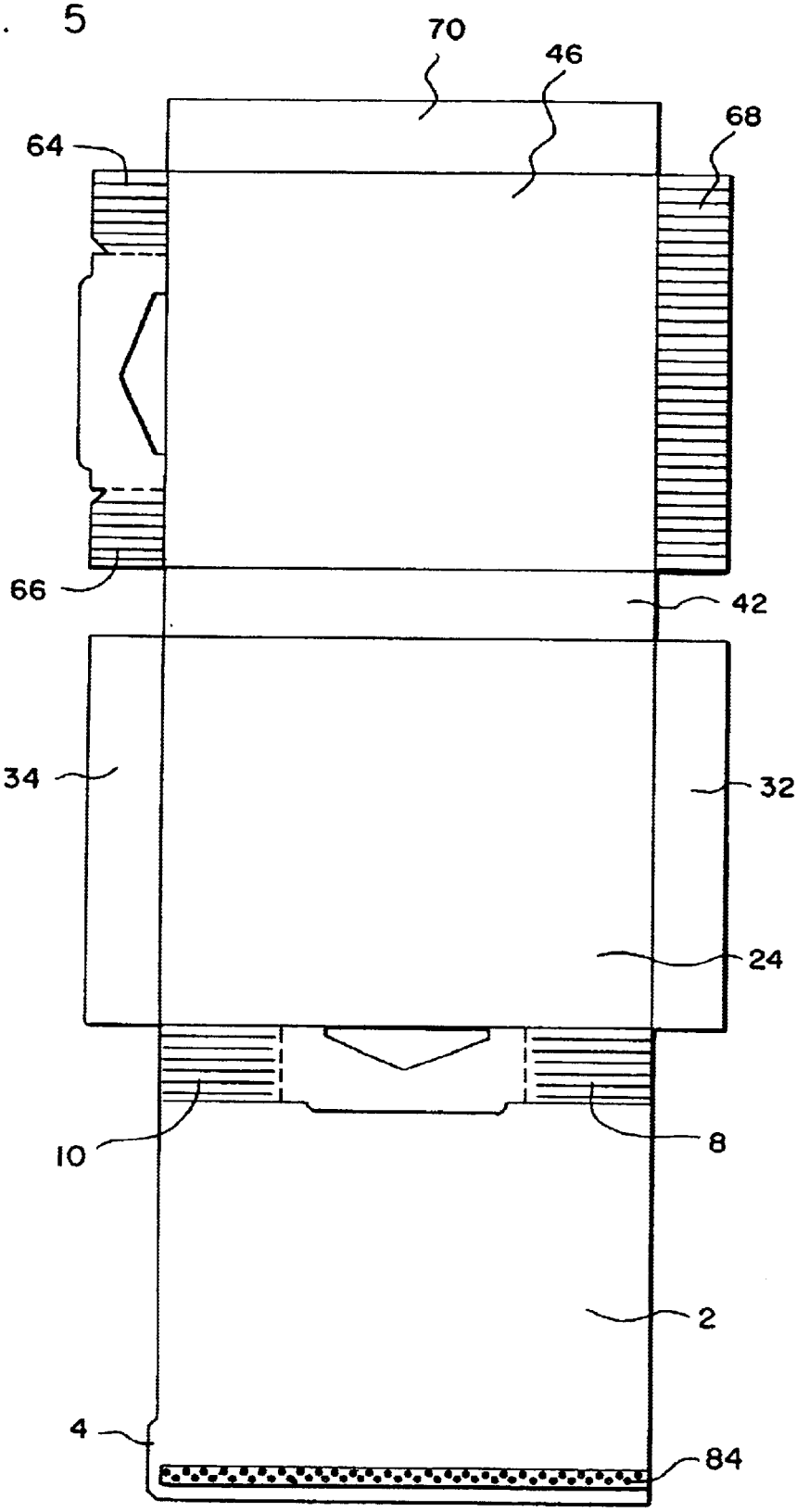
FIG. 5 is a plan view of a deconstructed container interior face.
Figure 10:
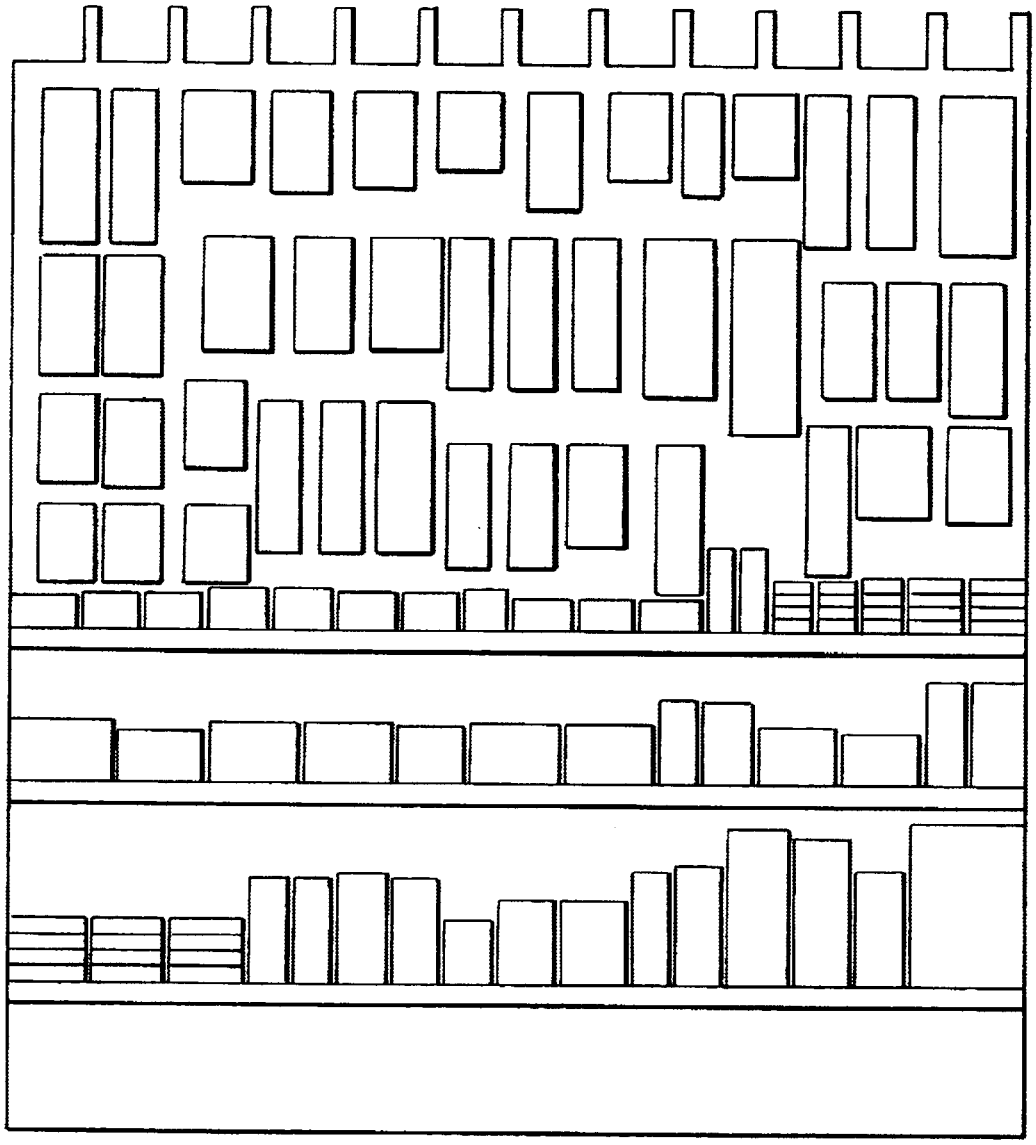
FIG. 10 is an illustrative example of retail store space product placement wherein product packages are displayed in a first position.
Figure 11:
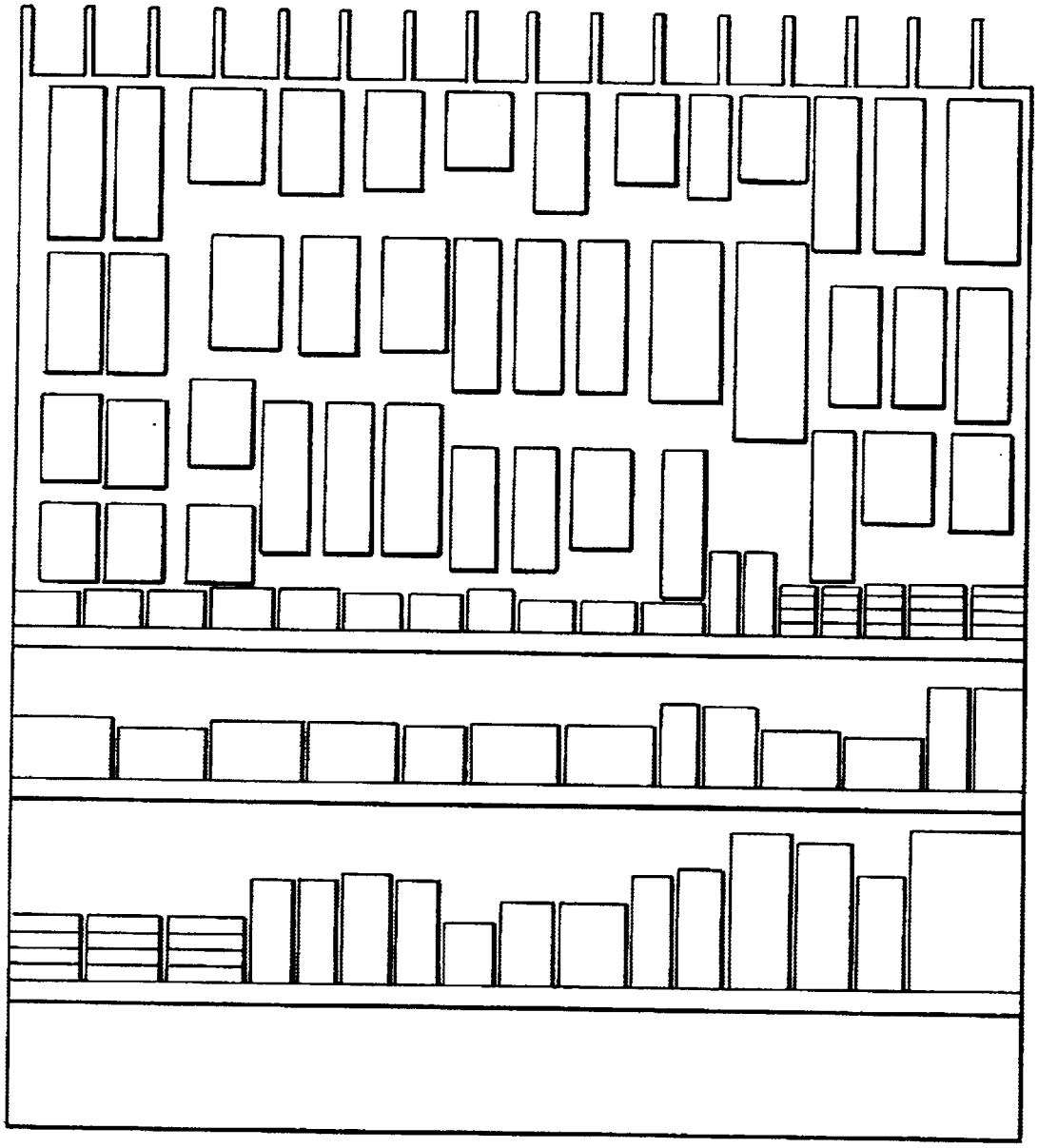
FIG. 11 is an illustrative example of retail store space product placement wherein product packages are displayed in a second position.

Referring first to FIGS. 1–3, an assembled display container is disclosed. The container has disposed thereon two separate hangers 12, 58 each having an opening formed therein 16, 60 for receiving a pole, rod, or other display support structure. The hangers are advantageously located on opposing edges 22, 52 of adjacent sides 6, 82 to allow advertising, content, or other information to be printed in alternate directions on the opposing front 24 and rear 46 panels. This arrangement allows the retailer to choose between alternate display positions that will best fit in the limited store space allocated for display of the package, as illustrated in FIGS. 10 and 11. This package is preferably constructed from a single piece of material, such as illustrated in FIGS. 4 and 5. This construction allows inexpensive manufacture of the package in large quantities while still satisfying the varying demands of retail display configurations. The product package is also suited for non-hanging display such as stacks or dispenser assisted display. The auxiliary or display flap 2 is a hinged flap that may be secured to the balance of the package (at a location additional to the hinge or fold 78) via the use of a non-binding fastening means such as a non-binding adhesive 80, 84.

The container of FIGS. 1–3 is illustrated in a deconstructed state in FIG. 4 (panel exterior face view) and FIG. 5 (panel interior face view). With reference to FIG. 4, the exterior or exterior-facing sides, panels, or tabs of a package are shown. A rear panel 46 is provided. A rear panel top edge 50 has a rear panel top flap 70 disposed adjacent thereto. The rear panel top edge 50 preferably comprises a fold line. The rear panel top flap 70 includes a rear panel top flap central region 72 that is generally non-adhesive as well as first 74 and second 76 rear panel top flap outer portions that bear a binding adhesive. A rear panel first side edge 48, preferably comprising a fold line, has a rear panel first side flap 68 disposed adjacent thereto. A rear panel second side edge 52, preferably a fold line, has a rear panel second side flap 82 located adjacent thereto. The rear panel second side flap 82 comprises a central region that is a second hanger 58 having a second hanger opening 60 formed therein. The second hanger 58 is separated from the balance or first 64 and second 66 outer portions of the rear panel second side flap 82 by first 54 and second 56 rear panel second side flap perforated lines. The rear panel 46 has a non-binding adhesive region 80 formed thereon generally near a rear panel bottom edge 44. The rear panel bottom edge 44 preferably comprises a fold line adjacent to a bottom panel 42.

A front panel 24 having a front panel bottom edge 28 is disposed such that the front panel bottom edge 28 preferably comprises a fold line adjacent to the bottom panel 42. A front panel first side edge 30, preferably comprising a fold line, separates the front panel 24 from a front panel first side flap 32. The front panel first side flap 32 preferably bears a binding adhesive. A front panel second side edge 26, preferably comprising a fold line, separates the front panel 24 from a front panel second side flap 34. The front panel second side flap 34 comprises a central region 38 substantially free of binding adhesive with the balance of the front panel second side flap comprising first 36 and second 40 front panel second side flap outer portions bearing a binding adhesive.

A front panel top edge 22, preferably comprising a fold line, separates the front panel 24 from a top panel 6. The top panel 6 comprises a central region that comprises a first hanger 12 having a first hanger opening 16 formed therein. The first hanger 12 is separated from first 8 and second 10 top panel outer portions by first 18 and second 20 top panel perforated lines. The first 12 and second 58 hangers have first and second hanger tabs 14, 62 extending therefrom to allow a user to catch the hangers 12, 58 and separate the hangers 12, 58 from the balance of the top panel 6 and rear panel second side flap 82 respectively.

A top panel front edge 78, preferably a fold line, separates the top panel 6 from an auxiliary or display flap 2. The auxiliary flap 2 has an auxiliary flap tab 4 extending therefrom to allow a user to conveniently catch the auxiliary flap.

The forgoing description is in reference to the preferred package exterior when the package is deconstructed and laid flat as illustrated in FIG. 4. Elements, have been identified as lines, tabs and panels, and it will be understood that tabs and panels have interior and exterior faces as shown in FIGS. 5 and 4 respectively. In FIG. 4, reference to the bearing of adhesive or the state of being substantially free of adhesive is meant to be specific to the exterior faces of the identified elements. In FIG. 5, the package of FIG. 4 has been rotated over its second side to expose the package interior. As illustrated in FIG. 5, the interior face of the rear panel first side flap 68, the outer portions of the rear panel second side flap 64, 66, and the outer portions of the top panel 8, 10 bear binding adhesive. In addition, there is shown an auxiliary flap region 84 of non-binding adhesive.

When this deconstructed package, container, or box is folded and joined, preferably via means of binding and non-binding adhesive at selected locations, the construction of FIGS. 1–3 may be obtained. Construction of the box is as follows. The rear panel 46 may be turned to form an angle of about 90 degrees with the bottom panel 42 along the rear panel bottom edge 44. Similarly, the front panel 24 may be turned to form an angle of about 90 degrees with the bottom panel 42 along the front panel bottom edge 28 to bring the interior faces of the rear panel 46 and front panel 24 into facing arrangement with one another to define a package interior.

When so disposed, the front panel first side flap 32 may be folded inward and the rear panel first side flap 68 may be folded inward over the front panel first side flap 32. Preferably, as shown, the exterior face of the front panel first side flap 32 and the interior face of the rear panel first side flap 68 both bear a binding adhesive to allow securement of these flaps to one another to create a seal that cannot be conveniently opened without destruction or disfigurement of the package. It will be apparent to those of ordinary skill in the packaging arts, upon learning the disclosure of the present invention, that this preferred embodiment may include slight reversals of adhesive placement. For example, flaps 32 and 68 may be reversed during construction so that flap 68 bears adhesive and is folded interior to flap 32. Further, the present invention (of which the preferred embodiment is merely one example) may be practiced in multiple forms that allow variable display positions with expanded printing surfaces.

Similarly, the front panel second side flap 34 may be folded inward and the rear panel second side flap 82 may be folded over the front panel second side flap 34. Preferably, as shown, the exterior faces of the first 36 and second 40 front panel second side flap outer portions and the outer portions 64, 66 of the interior face of the rear panel second side flap 82, both bear a binding adhesive to allow securement of these flaps to one another to create a seal that cannot be conveniently opened without destruction or disfigurement of the package. The central portion 38 of the exterior face of the front panel second side flap 34, and the interior face of the second hanger 58 are preferably substantially free of binding adhesive to allow the second hanger to be separated from the balance of the rear panel second side flap 82 and the front panel second side flap 34 when, a user (retailer, etc.) catches the second hanger tab 62 and pulls the second hanger 58 loose from the rear panel second side flap perforated lines 54, 56.

The rear panel top flap central portion 72 exterior face is substantially free,of adhesive and the exterior face of the rear panel top flap outer portions 74, 76 bear binding adhesive. The rear panel top flap 70 may be folded inwardly along the rear panel top edge 50 to form an angle of about 90 degrees with the rear panel 46. Similarly, the top panel 6 may be folded inwardly to substantially cover the rear panel top flap 70 and to form an angle of about 90 degrees with the front 24 and rear 46 panels. In this manner the binding adhesives of the rear panel top flap outer portions 74, 76 (exterior face) may be brought into secure connection with the binding adhesive of the top panel outer portions 8, 10 (interior face). In this manner, there is a reinforcing flap beneath each hanger 12, 58 to minimize the possibility of package destruction during hanger manipulation.

The display flap 2, which is moveably hinged along fold line 78, may be moved from a secured position to a viewing position relative to the rear panel. The display flap 2 has a display flap securement region 84 of non-binding adhesive that may be releaseably attached to the non-binding adhesive region 80 located on the rear panel 46 near the rear panel bottom edge 44.

Figure 6:
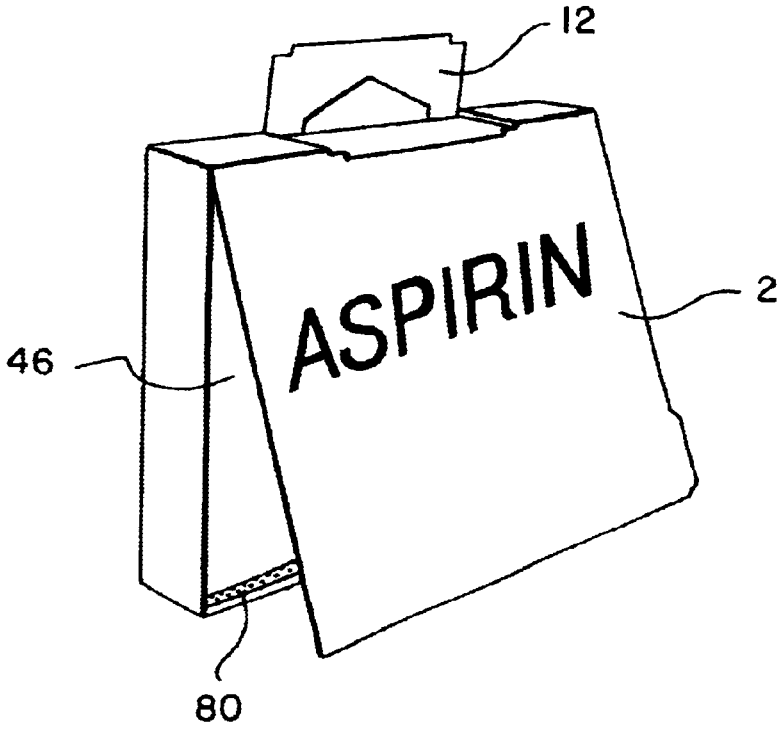
FIG. 6 is a rear offset perspective view of an assembled and printed container having a display flap.
Figure 7:
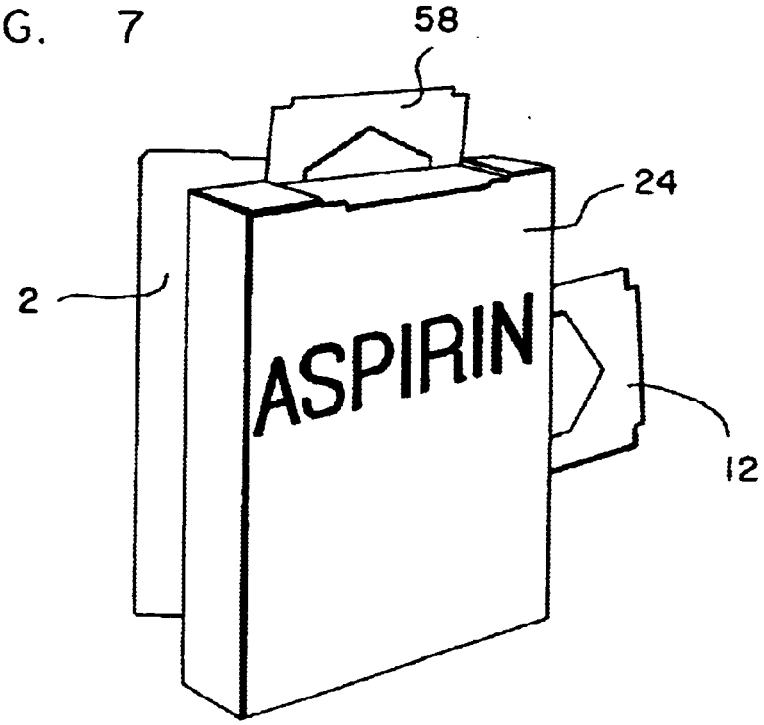
FIG. 7 is a front offset perspective view of an assembled and printed container having a display flap.
Figure 8:
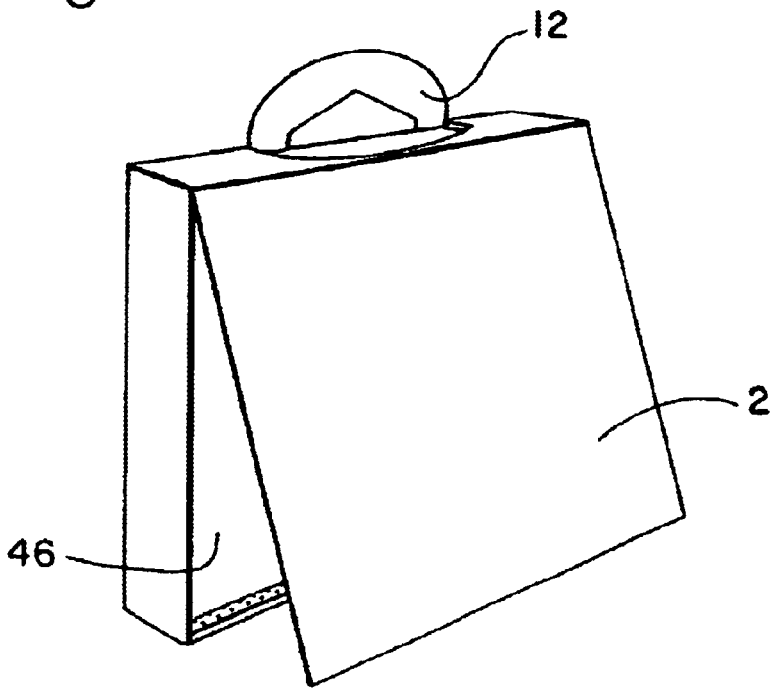
FIG. 8 is a rear offset perspective view of an assembled container having a second preferred hanger construction.

In this manner, text such as branding information, product name, trademark, manufacturer, FDA required disclosures, product content, and contact information may be printed on both sides of the auxiliary flap 2, as well as on housing that defines the package interior and comprises the panels and flaps other than the auxiliary flap. For example, text may be printed in different directions on different panels 24, 46 to allow the retail space manager to elect between various display positions. This advantageous feature allows the product package to be conveniently located in a taller, more narrow space or in a shorter, more broad space, as space limitations may allow (compare FIGS. 10 and 11). For example, in FIG. 1 text could be provided on the visible, exterior face of the auxiliary flap 2 printed in a direction from the viewer's left to the viewer's right. When the auxiliary flap is opened, a viewer would see text (preferably detailed non-prescription drug content, warning, and direction data) printed in smaller print from the viewer's left to the viewer's right in a generally continuous format extending from the interior face of the auxiliary flap 2 down and through the exterior face of the rear panel. Text on the front panel (rear facing and not shown in FIGS. 1 and 2 but illustrated conspicuously in FIG. 3) would be rotated from the text on the auxiliary flap 2 exterior face (when the auxiliary flap 2 is closed) to read from the viewer's left to right in FIG. 3. Therefore, as illustrated in FIG. 3, when a retail manager elects to display the container in the position of FIG. 3, the package has been rotated along two separate axes (with reference to a typical, 3 dimensional x, y, z axes system) relative to the position of the package in FIGS. 1 and 2. FIGS. 6 and 7 illustrate the text described above with reference to identical views as seen in FIGS. 1 and 3. FIGS. 10 and 11 illustrate in a simple manner a benefit that may be achieved by a retail store, through the variable display positions that are offered by the present invention. In FIG. 10, the box is illustrated in a first position (as illustrated in FIG. 1, 2, or 8). For a box having a parallelogram structure as illustrated, this first position allows a given number of units to be visibly displayed. In FIG. 11, the box is illustrated in a second position to allow a great number of units to be visibly displayed. The extent to which this variable display functionality enhances the number of units that may be displayed is, of course, a function of the box dimensions, box shape, and available store space.

Figure 9:
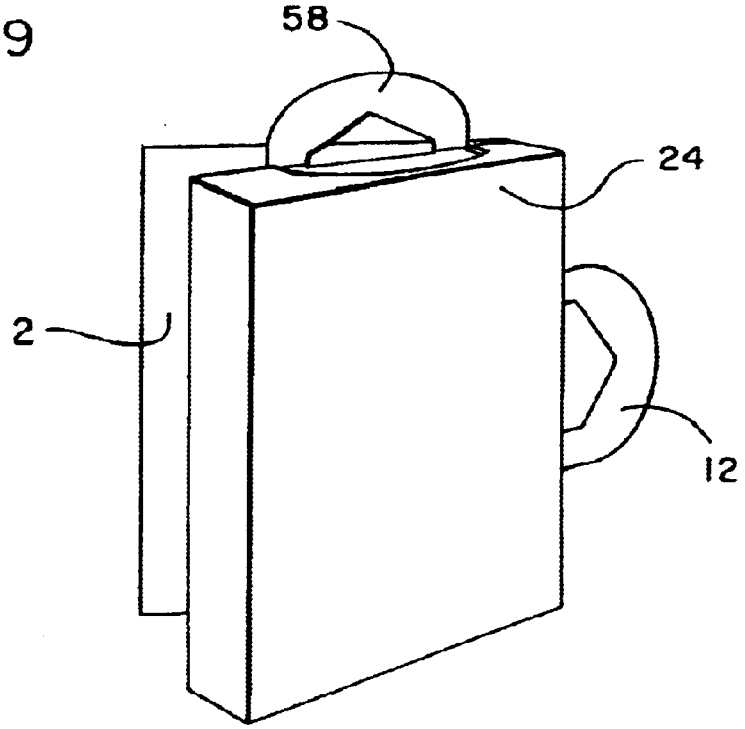
FIG. 9 is a front offset perspective view of an assembled container having a second preferred hanger construction.

FIGS. 8 and 9 illustrate a second preferred construction. In FIGS. 8 and 9, the hangers 12, 58 are modified in shape from the hangers shown in FIGS. 1–7. In FIGS. 8 and 9 the hangers' shape allows a greater area of the top panel 6 and rear panel second side flap 82 to bear binding adhesive, thereby enhancing the durability of the package and resistance to disfiguration when the hangers 12, 58 are separated from the top panel 6 and rear panel second side flap 82. Similarly, opening shapes and overall package configuration may be altered without departing from the present invention which encompasses variable position expanded printing surface packages as claimed below.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included within the scope of the following claims.

What is claimed is:

1. A variable position expanded printing surface display packaging comprising:

substantially planar rear panel having a rear panel top edge, a rear panel bottom edge, a rear panel first side edge, and a rear panel second side edge;

a rear panel top flap hingedly connected with the rear panel top edge, the rear panel top flap having a rear panel top flap first end portion, a rear panel top flap second end portion, and a rear panel top flap central portion;

a rear panel first side flap hingedly connected with the rear panel first side edge;

a rear panel second side flap hingedly connected with the rear panel second side edge, the rear panel second side flap comprising a rear panel second side flap first end portion, a rear panel second side flap second end portion, and a second hanger disposed between the rear panel second side flap first and second end portions, the second hanger having an opening formed therein;

a bottom panel hingedly connected with the rear panel bottom edge;

a front panel having a front panel bottom edge, a front panel top edge, a front panel first side edge, and a front panel second side edge, the front panel bottom edge being hingedly connected with the bottom panel;

a front panel first side flap being hingedly connected with the front panel first side edge;

a front panel second side flap, comprising a front panel second side flap first end portion, a front panel second side flap second end portion and a front panel second side flap central portion;

a top panel hingedly connected with the front panel top edge, the top panel comprising a top panel first end portion, a top panel second end portion, and a first hanger disposed between the top panel first and second end portions, the first hanger having an opening formed therein;

the top panel further comprising a top panel front edge;

an auxiliary panel hingedly connected with the top panel front edge.

2. The variable position expanded printing surface display package of claim 1 wherein: the rear panel top flap first and second outer ends bear a binding adhesive.

3. The variable position expanded printing surface display package of claim 1 wherein: the rear panel has an auxiliary panel securement region located thereon, the auxiliary panel securement region bearing a non-binding adhesive.

4. The variable position expanded printing surface display package of claim 1 wherein: the front panel first side flap bears a binding adhesive thereon.

5. The variable position expanded printing surface display package of claim 1 wherein: the front panel second side flap first and second ends bear a binding adhesive thereon.

6. The variable position expanded printing surface display package of claim 1 wherein: the first hanger is separated from the top panel outer ends by perforations.

7. The variable position expanded printing surface display package of claim 1 wherein: the second hanger is separated from the rear panel second side flap outer ends by perforations.

8. The variable position expanded printing surface display package of claim 1 wherein: the package is a single sheet of packaging material in combination with selectively placed binding and non-binding adhesive and wherein the hinged connections comprise fold lines in a single sheet of material.

9. The variable position expanded printing surface display package of claim 1 wherein the first hanger has a first hanger tab.

10. The variable position expanded printing surface display package of claim 1 wherein the second hanger has a second hanger tab.

11. The variable position expanded printing surface display package of claim 1 wherein the auxiliary panel has an auxiliary panel tab.

* * * * *